US005362245A

United States Patent [19]

Suguro et al.

[11] Patent Number: 5,362,245

[45] Date of Patent: Nov. 8, 1994

[54] FRAME-COUPLING-TYPE ELECTRICAL CONNECTOR

[75] Inventors: Masahiro Suguro; Yoshinori Ohumura; Minoru Imamura, all of Shizuoka, Japan

[73] Assignee: Yazaki Corporation, Japan

[21] Appl. No.: 134,667

[22] Filed: Oct. 13, 1993

[30] Foreign Application Priority Data

Oct. 14, 1992 [JP] Japan ..... 4-275846

[51] Int. Cl.[5] ..... H01R 13/629

[52] U.S. Cl. ..... 439/160

[58] Field of Search ..... 439/341, 310, 372, 157, 439/160

[56] References Cited

U.S. PATENT DOCUMENTS 3,784,954 1/1974 Grimm et al. ..... 439/160

5,135,408 8/1992 Suzuki et al. ..... 439/310

FOREIGN PATENT DOCUMENTS 60-178978 11/1985 Japan .

*Primary Examiner*—Gary F. Paumen

*Attorney, Agent, or Firm*—Wigman, Cohen, Leitner & Myers

[57] ABSTRACT

A frame-coupling-type connector includes a first connector, a second connector to be engaged with the first connector, a frame pivotably supported at a central portion thereof by the first connector and having an effect of a lever, and a coupling mechanism. The coupling mechanism includes a frame-side engaging portion provided at one end of the frame and a connector-side engaging portion provided at one side of the second connector. The frame-side engaging portion and the connector-side engaging portion are pivotably and slidably engaged with each other. The first connector is engaged with the second connector in a straight line by the effect of the lever of the frame and by the coupling mechanism.

5 Claims, 6 Drawing Sheets

FRAME-COUPLING-TYPE ELECTRICAL CONNECTOR

BACKGROUND OF THE INVENTION

1. Technical Field

The present invention relates to a frame-coupling-type connector which Is applicable to multipole connectors for constructing electric circuits and obtain secure connection between the male and female connectors with reduced coupling force.

2. Background Art

In the multipole connectors, it is difficult to fit the male and female connectors together by hand because such coupling work requires considerable force. Therefore, in Japanese Utility Model Registration Application for Disclosure No.60-178978, there is disclosed a method, as shown in FIGS. 1 and 2, of reducing the coupling force between these mating connectors utilizing the principle of the lever and fulcrum positioned at both end portions of the male connector 1 and the female connector 2.

However, since in the connector shown in FIG. 1, the male terminals 4 and female terminals 5 are mutually moved circularly on fitting the male connector 1 into the female connector 2, the insertion or pulling out operation between these connectors cannot be carried out straight as seen in the normal-type male and female terminals. Accordingly, there is necessity of such a special terminal structure as shown in FIG. 2, that each fitting distal end 6 of the female terminals 5 be suitably opened, and the terminal cavity should provide a special housing structure. Therefore, the structural complication leads to difficult production or preparation of parts and troublesome maintenance. In addition, there is still the problem of poor reliability of connection between the terminals.

SUMMARY OF THE INVENTION

It is therefore an object of the present invention to provide a highly reliable frame-coupling-type connector in which the force required for fitting together the male and female connectors can be reduced, the engagement between both of the connectors can be carried out in a straight line, and conventional male and female terminals now widely used are directly applicable.

To achieve the above object, the present invention provides a frame-coupling-type connector including a first connector, a second connector to be engaged with the first connector, a frame pivotably supported at a central portion thereof by the first connector and having an effect of a ever, and a coupling mechanism. The coupling mechanism includes a frame-side engaging portion provided at one end of the frame and a connector-side engaging portion provided at one side of the second connector. The frame-side engaging portion and the connector-side engaging portion are pivotably and slidably engaged with each other. The first connector is therefore engaged with the second connector in a straight line by the lever of the frame and by the coupling mechanism.

In the above frame-coupling-type connector, the frame can pivot about the frame engaging portion while along the connector engaging portion of the second connector, and the first connector can pivot freely about its support shaft supported by the frame. Therefore, the first and second connectors can be fitted together or pulled out from each other in a straight line while facing straight mutually. Accordingly, the force required for fitting together both of the connectors can be markedly reduced due to the effect of the lever-like mechanism about the frame engaging portion. Moreover, the male and female terminals of the conventional type can be directly applied to this connector.

DESCRIPTION OF THE PREFERRED EMBODIMENT

Hereinafter, several embodiments of the present invention will be described with reference to the drawings.

Figure 1:
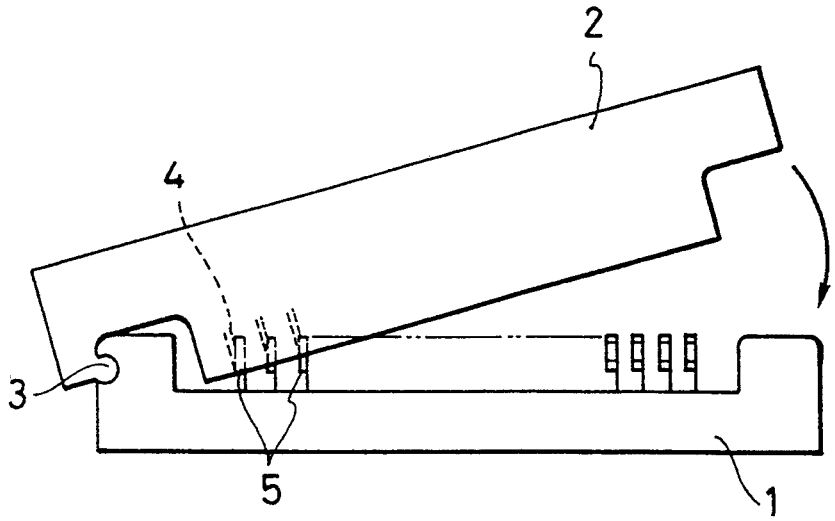
FIG. 1 PRIOR ART
FIG. 1 is a front view of a connector related to the background art.
Figure 2:
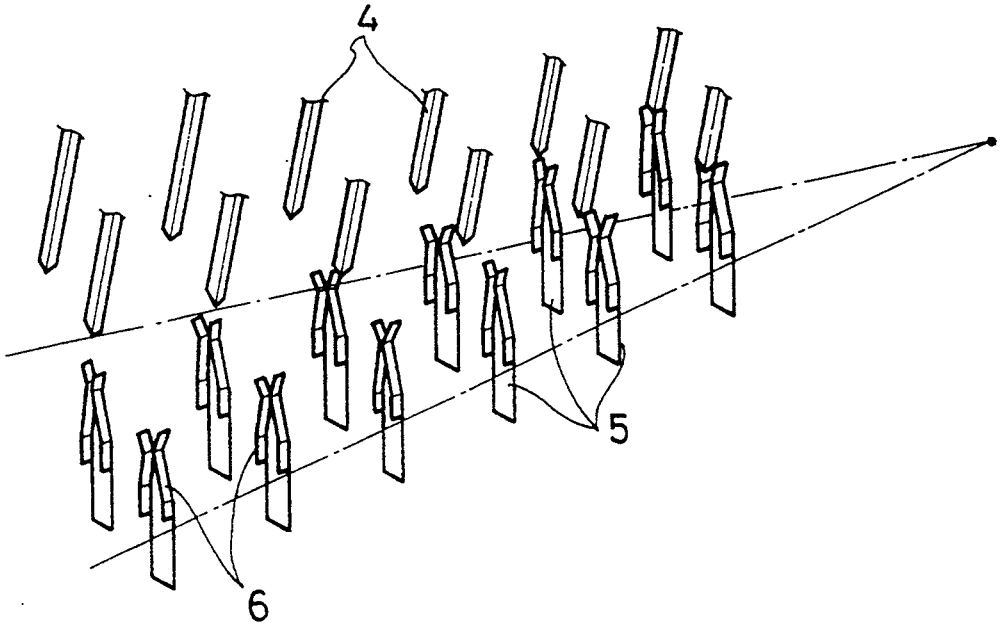
FIG. 2 PRIOR ART
FIG. 2 is a schematic diagram showing a joint relation of the terminals of the connector of FIG. 1.
Figure 3:
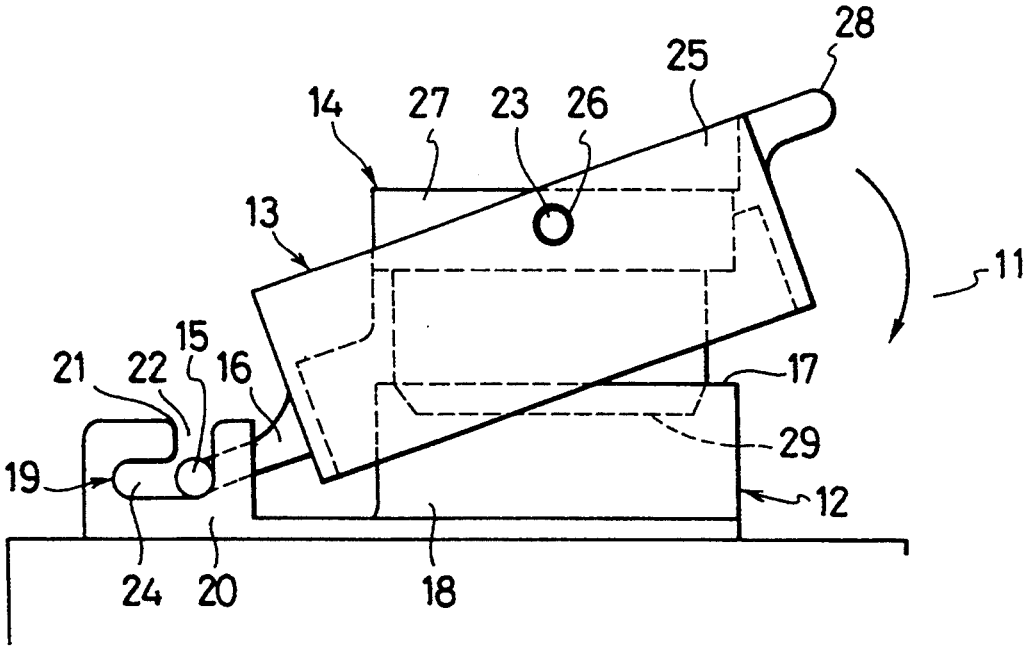
FIG. 3 is a side view of a frame-coupling-type connector as an embodiment of the present invention.

FIG. 3 is a side view of a frame-coupling-type connector 11 as one embodiment of the present invention. The frame-coupling-type connector 11 comprises a female connector 12, a frame 13 and a male connector 14 supported by the frame 13. The frame 13 has a support leg 16 which extends outward from one end of the frame 13 and has a slide bar 15 at its distal end.

The female connector 12 is formed on a support, such as junction block or like member (not shown), and comprises a fitting portion 17 extending upward to be engaged with the male connector 14 and a housing 18 containing a plurality of terminals (not shown). At one end of the female connector 12 a frame support portion 20 provided with a projecting slide groove 19 is.

The slide groove 19 comprises an opening 22 formed through the top wall 21 of the frame support portion 20 and a slide portion 24 bending the opening 22 and extending substantially vertically to a support shaft 23 of the male connector 14.

Figure 4:
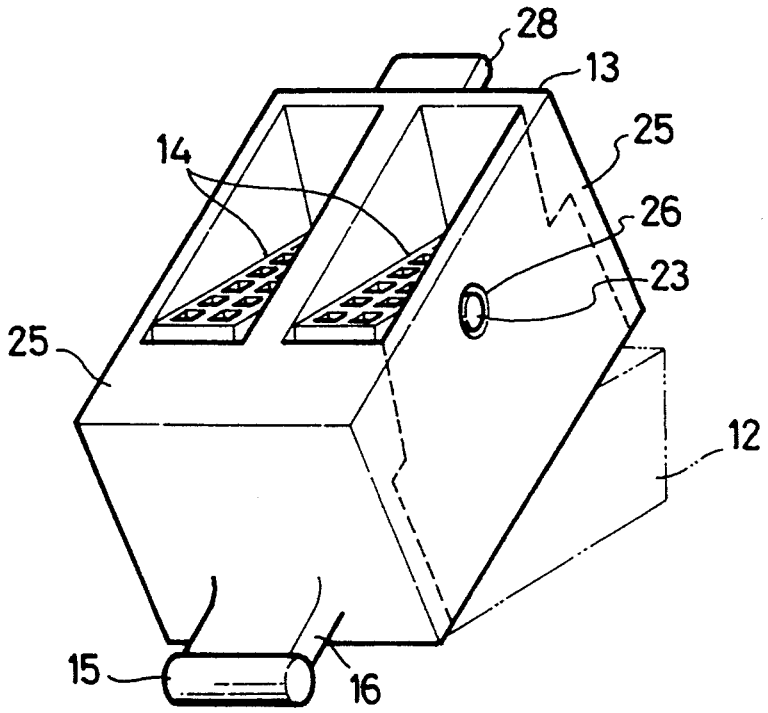
FIG. 4 is a perspective view of the frame shown in FIG. 3.

Namely, as shown in FIG. 4, the support shaft 23 extends from the side faces 27 of the male connector 14 and is inserted in support holes 26 formed in both the side faces 25 of the frame 13, so as to pivotably support the male connector 14. In addition, at the other end of the frame 13 an operating portion 28 projects to pivot the frame 13. In this case, the number of male connectors 14 in the frame 13 is not limited in particular, and optionally, a plurality of male connectors may be mounted.

Each male connector 14 contains a plurality of terminals (not shown) to be connected with the terminals in the female connector 12 and mounted in the frame 13 with fitting portion 29 extending downward corresponding to the female connector 12.

Figure 5:
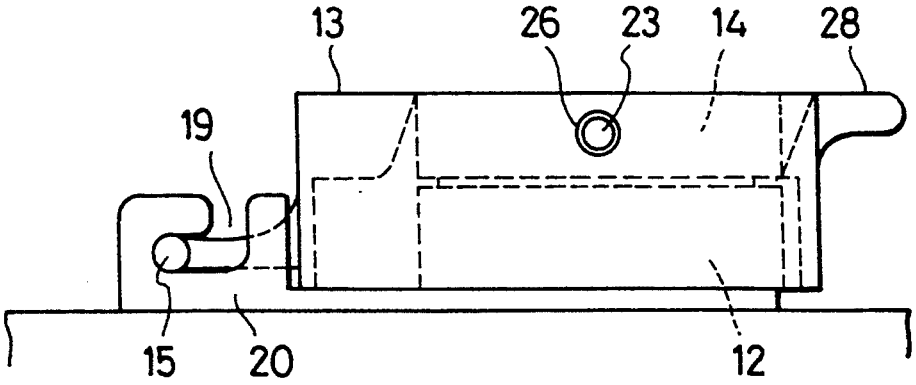
FIG. 5 is a side view showing a state in which the male connector and female connector of FIG. 3 are fitted together.

To fit the above female connector 12 and male connector 14 together, the slide bar 15 of the frame 13 is engaged in the slide groove 19 of the female connector 12 to securely place the male connector 14 (supported by the frame 13) over the female connector 12. Then the operating portion 28 of the frame 13 is pushed down to completely fit the female connector 12 and male connector 14 together as shown in FIG. 5.

At that time, since the frame 13 pivots about the slide bar 15 while the bar 15 sliding in the slide groove 19, the support shaft 23 of the frame 13 can move straight until the fitting of these connectors is completed. Moreover, since each male connector 14 is pivotably supported by the frame 13 about the support shaft 23, it can be moved straight always keeping a state facing the female connector 12.

On the other hand, the coupling between the female connector 12 and male connector 14 can be removed with ease by pushing up the operating portion 28.

Figure 6:
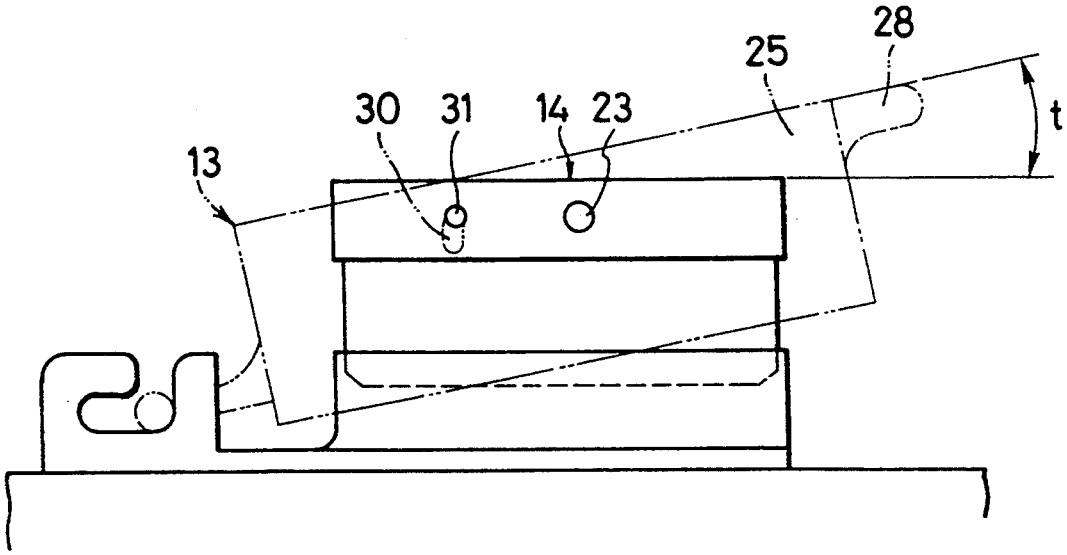
FIG. 6 is a diagram showing another embodiment of the present invention.
Figure 7:
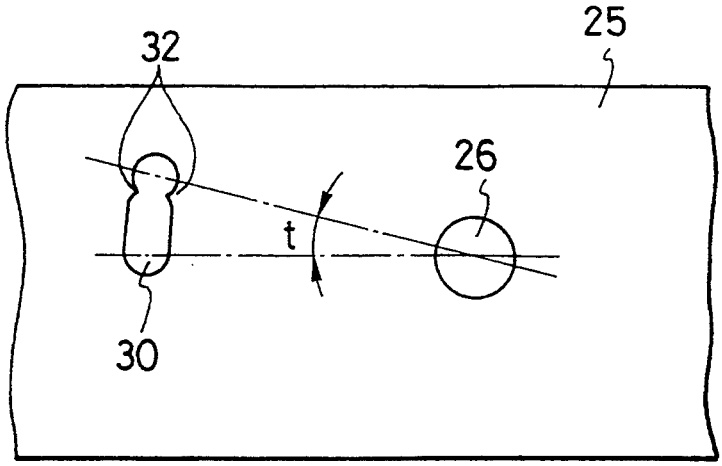
FIG. 7 shows an important portion of the frame shown in FIG. 6.

FIG. 6 shows another embodiment of the present invention, in which a pivot restricting groove 30 as pivot restricting means is formed in the side face 25 of the frame 13, and a pivot restricting projection 31 as pivot restricted means is provided on the side face of the housing 27 of male connector 14 together with the support shaft 23.

Since the male connector 14 is pivotably supported by the frame 13, the angle of the male connector 14 to the female connector 12 may shift from a desired value due to pulling force on the wire harness or the like effect on connecting them together. Thus, in some cases, the alignment of these engaging portions becomes troublesome.

Therefore, this embodiment is so constructed that such unnecessary pivot movement of the male connector 14 can be prevented by engaging the pivot restricting groove 30 formed in the side face 25 of the frame 13 with the pivot restricting projection 31 provided on the side face 27 of the housing of male connector 14 together with the support shaft 23.

Namely, as shown In FIG. 6, the pivot restricting groove 30 is so formed as to allow the pivot restricting projection 31 to move along the groove 30 when the male connector 14 pivots about the frame 13 within a predetermined angle t frown the beginning to end of the connecting operation. At the upper end of the groove 30 opposed stop projections 32 are provided to temporarily stop the male connector 14 by the frame 13 at the beginning of the connecting operation.

Figure 8:
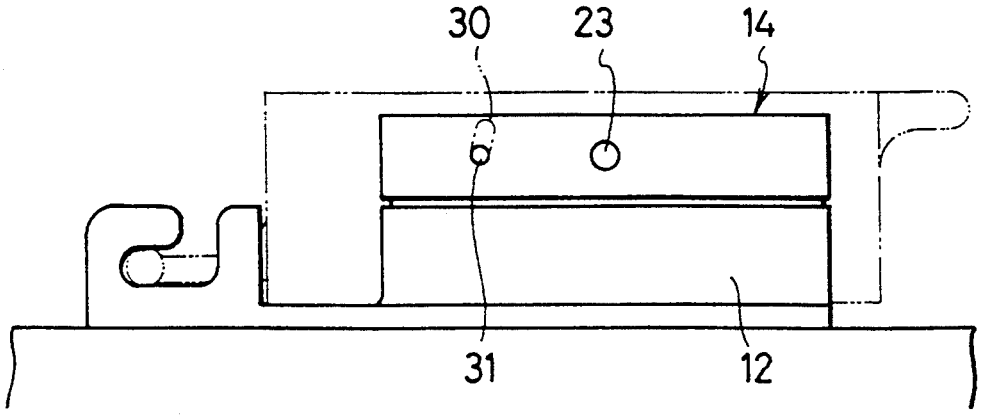
FIG. 8 is a diagram showing a state in which the male and female connectors of FIG. 6 are fitted together.

In more detail, when the male connector 14 is fitted In the female connector 12, the pivot restricting projection 31 of the male connector 14 is located at the upper end of the pivot restricting groove 30 and engaged with the stop projections 32 of the groove 30 to temporarily stop the connector 14 to the frame 13. After the male connector 14 is placed over the female connector 12 in that manner, the frame 13 is pressed down to start the connection. The temporary stop is removed if the pivot restricting projection 31 of the male connector 14 moves over the stop projections 32 of the pivot restricting groove 30. Then the coupling between the male connector 12 and female connector 14 progresses with the pivot movement of frame 13 and is completed as shown in FIG. 8.

In that way, the unnecessary pivot movement of male connector 14 to be generated during the coupling operation can be prevented by temporarily stopping the male connector 14 to the frame 13 at the beginning of that coupling operation while its engaging axis being coincident with the axis of the mating connector 12. Therefore, the coupling of these connectors can be carried out smoothly.

Figure 9:
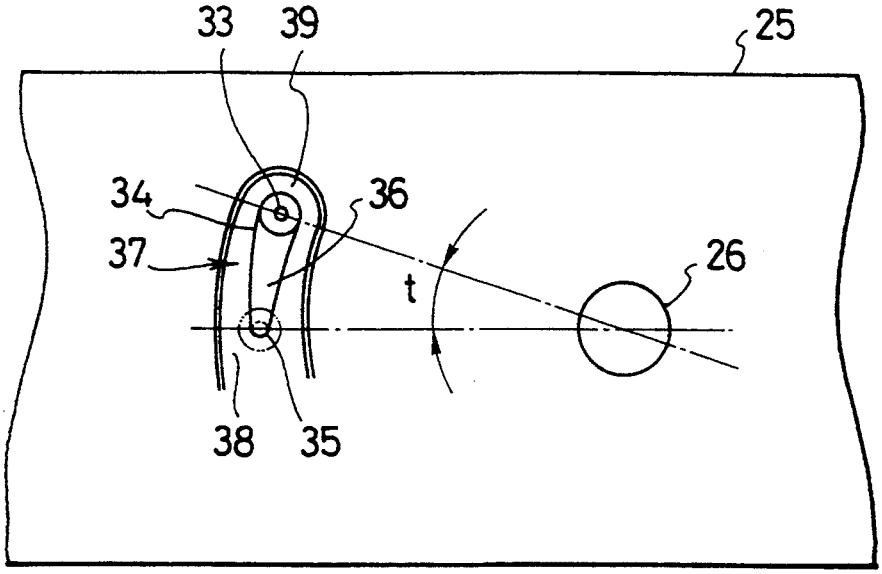
FIG. 9 is a diagram showing still another embodiment of the present invention.
Figure 10:
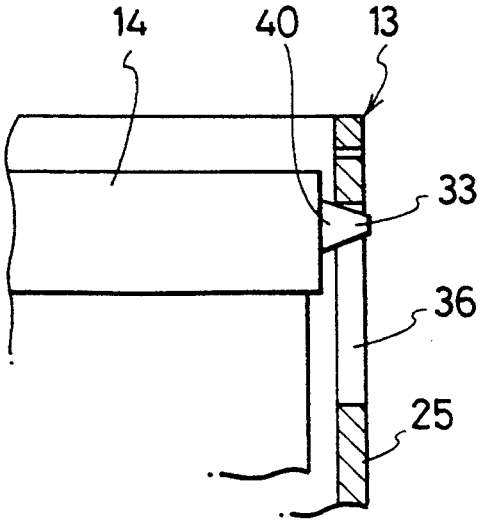
FIG. 10 is a diagram showing a state in which the pivot restricting groove and pivot restricting projection of FIG. 9 are engaged with each other.

FIGS. 9 and 10 show still another embodiment of the present invention, in which a conical pivot restricting projection 33 is provided at the male connector 14. On the other hand, in the side face 25 of frame 13, a pivot restricting groove 36 is formed in accordance with the pivot angle t of the male connector 14 in pivoting about the frame 13 during the whole coupling operation. The pivot restricting groove 36 has a relatively wide gap 34 at its engaging start position and a relatively narrow gap 35 at its engaging end position. In addition, the groove 36 is provided in a cut portion 37 defined by a U-shaped cut line. The distal portion 39 of the cut portion 37 can open and close about its base portion 38 due to the elasticity of the material constituting the frame 13.

FIG. 10 shows a state prior to the coupling of connectors, in which the base portion 40 of pivot restricting projection 33 is engaged with the relatively wide gap 34 of pivot restricting groove 36 so that a stable state can be maintained at a predetermined angle.

Figure 11:
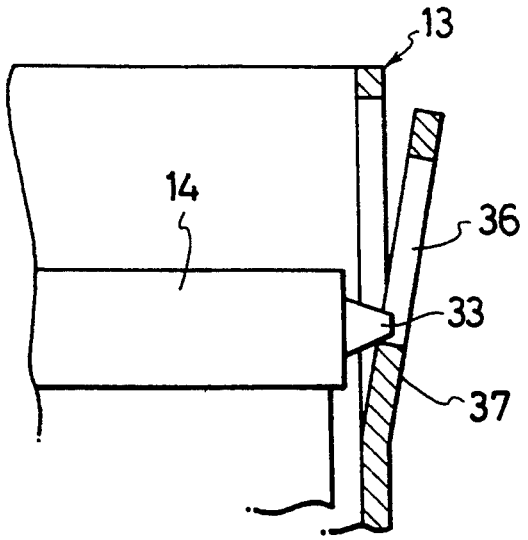
FIG. 11 is a diagram showing another state of engagement between the pivot restricting groove and pivot restricting projection on fitting together the connectors of FIG. 10.

On the other hand, FIG. 11 shows a state in which both the connectors are coupled together by pushing down and pivoting the frame 13. As shown in the same drawing, the cut portion 37 is opened because the portion 37 is gradually pressed outward by the pivot restricting projection 33 as the gap of pivot restricting groove 36 becomes narrower with the slide movement of projection 33 along the groove 36.

If the frame 13 is pivoted in the reverse direction to remove the coupling of male connector 14, the original state as shown in FIG. 8 returns automatically because the elasticity of cut portion 37 pushes up the conical pivot restricting projection 33 to the wide gap 34 of pivot restricting groove 36 by the removement of male connector 14.

Though in either of the above embodiments the frame support portion 20 is provided at the female connector 12 and the male connector 14 is mounted at the frame 13, the present invention is not limited to such a mode. Namely, it is also possible to mount the frame 13 on the side of female connector 12 and provide the frame support portion at the male connector 14.

Figure 12:
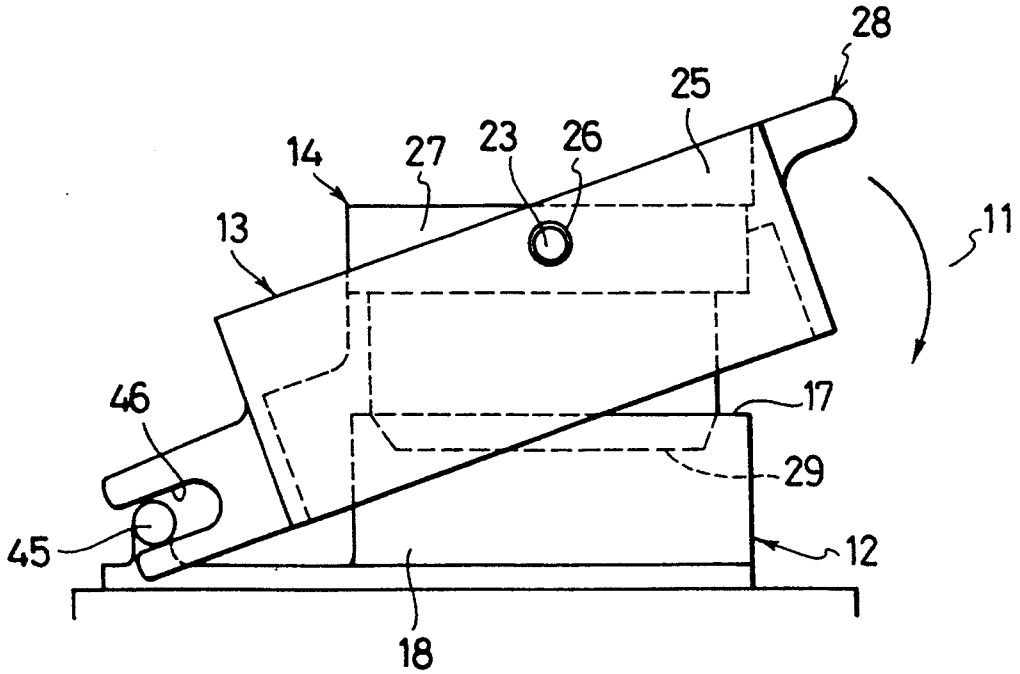
FIG. 12 is a side view showing a frame-coupling-type connector as still another embodiment of the present invention.

Similarly, the present invention is not limited to such construction that the slide groove 19 is provided on the side of female connector 12 while the slide bar 15 is provided on the side of frame 13 as disclosed in the above embodiments. Therefore, as shown in FIG. 12, the slide bar 45 may be formed on the side of female connector 12 while the slide groove 46 may be provided on the side of frame 13.

As stated above, according to the present invention, the coupling force can be markedly reduced by the effect of the lever on the slide bar in the vertical operation of the frame operating portion on coupling or disconnecting the male and female connectors. In addition, since the coupling or disconnection between both the connectors can be carried out in a straight line while the connectors directly face each other, the conventional male and female terminals or terminal cavity construction of straight coupling type can be utilized without requiring any modification. Therefore, the system of this invention can not only facilitate the preparation of necessary parts or system maintenance, but can also realize connectors with a highly-enhanced multipole level or density.

Various modifications will become possible for those skilled in the art after receiving the teachings of the present disclosure without departing from the scope thereof.

What is claimed is:

1. A frame-coupling-type electrical connector, comprising:

a) a first electrical connector having electrical contacts;

b) a second electrical connector having electrical contacts, to be engaged with said first electrical connector;

c) a frame pivotably supported at a central portion thereof by said first electrical connector: and d) a coupling mechanism including a frame-side engaging portion provided at one end of said frame and a connector-side engaging portion provided at one side of said second electrical connector, said frame-side engaging portion and said connector-side engaging portion being pivotably and slidably engaged with each other;

wherein said connector-side engaging portion is a slide groove extending in a first direction crossing a coupling direction of said first and second electrical connectors, and said frame-side engaging portion is a shaft to be engaged in said slide groove, and whereby said first electrical connector is to be engaged with said second electrical connector in a straight line by a lever of said frame and by said coupling mechanism.

2. A frame-coupling-type electrical connector according to claim 1, wherein a restricting means for restricting a swing angle of said first connector to said frame is provided between said first connector and said frame.

3. A frame-coupling-type electrical connector according to claim 2, wherein said restricting means includes a swing restricting groove with a shape of circular-arc formed in said frame and a swing restricting projection provided at said first connector to be engaged in said swing restricting groove.

4. A frame-coupling-type electrical connector according to claim 3, wherein a stop projection for temporarily holding said swing restricting projection is provided in said swing restricting groove.

5. A frame-coupling-type connector according to claim 4, wherein said frame has a tongue-like portion in which said swing restricting groove is provided, and said swing restricting groove has a relatively wide gap at a first end of said groove where said swing restricting projection is positioned when said first and second connectors are connected.

* * * * *